US005454119A

United States Patent [19]

Thomm

[11] Patent Number: 5,454,119

[45] Date of Patent: Oct. 3, 1995

[54] BED JACKET

[76] Inventor: Joyce M. Thomm, 3250 S. Griffin Ave., Milwaukee, Wis. 53207

[21] Appl. No.: 195,071

[22] Filed: Feb. 7, 1994

[51] Int. Cl.[6] ..... A41D 10/00

[52] U.S. Cl. ..... 2/114; 2/46; 2/48; 2/49.2; 2/69; 2/106; 2/247

[58] Field of Search ..... 2/46, 47, 48, 49.1, 2/49.2, 50, 49.3, 51, 49.4, 49.5, 52, 69, 69.5, 75, 80, 83, 104, 105, 106, 114, 247, 248, 249, 250, 251, 252, 253, 254

[56] References Cited

U.S. PATENT DOCUMENTS

| | | | |
|---|---|---|---|
| 415,837 | 11/1889 | Frisbee | 2/51 |
| 2,727,240 | 12/1955 | Marshall | 2/50 |
| 3,004,315 | 10/1961 | Masure | 2/52 X |
| 3,727,236 | 4/1973 | Lloyd et al. | 2/51 |
| 4,754,500 | 7/1988 | Brucato et al. | 2/114 X |
| 4,829,602 | 5/1989 | Harreld et al. | 2/51 |
| 4,837,860 | 6/1989 | Roberts et al. | 2/51 |
| 4,873,725 | 10/1989 | Mitchell | 2/52 X |
| 5,036,547 | 8/1991 | Silas | 2/46 X |

*Primary Examiner*—Jeanette E. Chapman
*Attorney, Agent, or Firm*—David L. Baker; Rhodes & Ascolillo

[57] ABSTRACT

A bed jacket has a torso portion. The torso portion has a closed frontal portion and a neck opening seam attached to a top portion of the closed frontal portion. A left arm opening seam and a right arm opening seam are attached to the closed frontal portion. A partially open rear portion is attached to the closed frontal portion. The left sleeve portion and the right sleeve portion are attached, respectively, to the left arm opening seam and to the right arm opening seam. There is a bib portion releasably attached to a front surface of the closed frontal portion. A multi-compartment belt is attached to the closed frontal portion. There is a shoulder support portion attached to the closed frontal portion. The shoulder support portion is also attached to the partially open rear portion. The shoulder support portion has a releasably fastened securing member attached to a neckband or collar member.

1 Claim, 1 Drawing Sheet

BED JACKET

BACKGROUND OF THE INVENTION

1. Field of the Invention

This invention relates to a bed jacket in general and in particular to a bed jacket that assists the wearer in organizing entertainment such as smoking items, television accessories, health care, food and reading materials. The jacket, in particular, features a bib and a compartmented belt.

2. Description of the Related Art

Previously constructed bed jackets have attempted to provide the wearer with a certain modicum of comfort. None have addressed the needs of the modern wearer of such apparel.

U.S. Pat. No. 2,523,636 to D. W. Sherman on Sep. 25, 1950 for a Jacket for reading in Bed describes a jacket that is formed from a single piece of cloth and is zipped instead of using bulky snaps, buttons or clasps.

U.S. Pat. No. 2,603,789 to T. Straus on Jul. 22, 1952 for a Bed Jacket and Similar Wearing Apparel shows a jacket that is buttoned in the front and slit partially up the back. The back portion is drawn back together by elastic bands.

U.S. Pat. No. 2,675,556 to J. R. Collier on Apr. 20, 1954 for a Bed Jacket describes a jacket with a closed front, elastic cuffs and an open back. It has one small chest pocket.

The present invention has improved upon conventional bed jackets by providing useful accessories that address the lifestyles of the present day users of such apparel who often watch television, play video games or read and eat while snug in bed.

SUMMARY OF THE INVENTION

In a first embodiment of the present invention, a bed jacket is shown that has a torso portion. The torso portion has a closed frontal portion. There is a neck opening seam attached to a top portion of the closed frontal portion. A left arm opening seam and a right arm opening seam are attached to the closed frontal portion. A partially open rear portion is attached to the closed frontal portion. The left sleeve portion and the right sleeve portion are attached, respectively, to the left arm opening seam and to the right arm opening seam. There is a shoulder support portion, attached to the closed frontal portion and attached to the partially open rear portion. The shoulder support portion has a releasably fastened securing member attached to a neckband member.

In a second embodiment of the present invention, a bed jacket is shown that has a torso portion. The torso portion has a closed frontal portion. A neck opening seam is attached to a top portion of the closed frontal portion. There is a left arm opening seam and a right arm opening seam attached to the closed frontal portion. A partially open rear portion attached to the closed frontal portion. There is a left sleeve portion and a right sleeve portion attached, respectively, to the left arm opening seam and to the right arm opening seam. A multi-compartment belt is attached to the closed frontal portion. There is a shoulder support portion, attached to the closed frontal portion and also attached to the partially open rear portion. The shoulder support portion has a releasably fastened securing member attached to a neckband member.

It is an object of this invention to provide a jacket to wear in bed that is both convenient for the wearer to utilize and keep the upper body of the wearer warm.

It is another object of the invention to provide a bed jacket that allows the wearer to lie comfortably in bed without drawing the covers up over the upper body and yet not be burdened with restrictive sleeping apparel above the waist.

DESCRIPTION OF THE PREFERRED EMBODIMENTS

Figure 2:
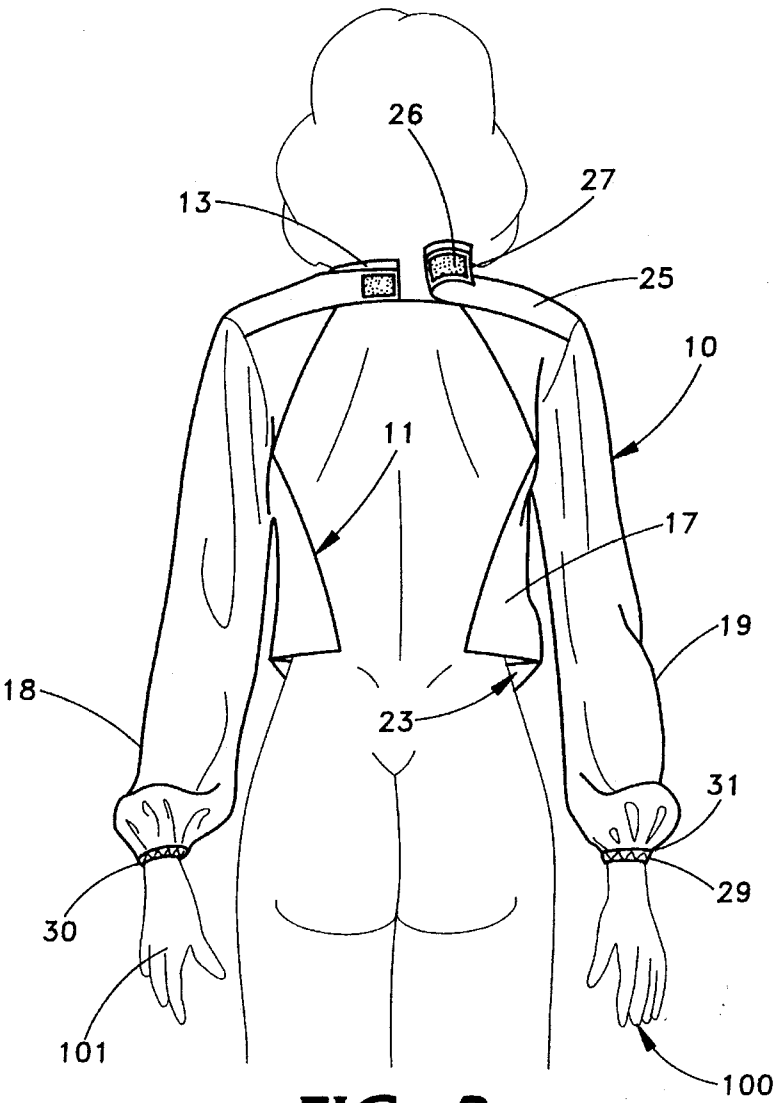
FIG. 2 is a rear elevational view of a Bed Jacket showing of the neckband member turned back to show the garment securing member.
Figure 1:
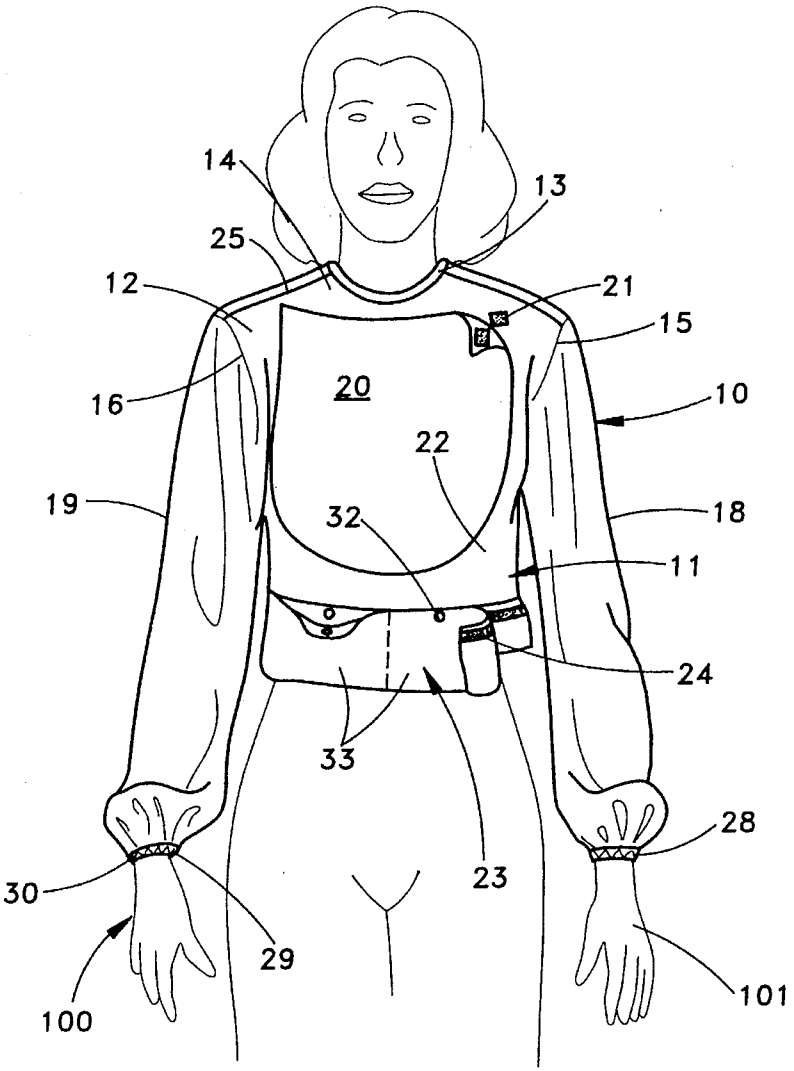
FIG. 1 is a front elevational view of a Bed Jacket showing a corner of the detachable and replaceable bib turned back at a corner to show the fastening member and also shows a portion of the detachable and replaceable multiple compartment belt turned back to show the fastening member.

Referring to FIGS. 1 through 2, a bed jacket 10 is shown and described that has a torso portion 11. The torso portion has a closed frontal portion 12 and a neck opening seam 13 attached to a top portion 14 of the closed frontal portion 12. A left arm opening seam 15 and a right arm opening seam 16 are attached to the closed frontal portion. A partially open rear portion 17 is attached to the closed frontal portion 12. The left sleeve portion 18 and the right sleeve portion 19 are attached, respectively, to the left arm opening seam 15 and to the right arm opening seam 16. The partially open rear portion 17 and the sleeves portions 18 and 19 may be sewn to the closed frontal portion 12 by known methods.

There is a bib portion 20 is releasably attached, preferably by a hook and loop fastener 21, to a front surface 22 of the closed frontal portion. A multi-compartment belt 23 is attached, preferably by a hook and loop fastener 24, to the closed frontal portion. Both the bib portion 20 and the multi-compartment belt 23 may be removed, if desired, for convenience or cleaning. There is a shoulder support portion 25, attached (usually by sewing) to the closed frontal portion 12. The shoulder support portion 25 is also attached (usually by sewing) to the partially open rear portion 17. The shoulder support portion has a releasably fastened securing member 26 (preferably a hook and loop fastener) attached to a neckband 27 to keep the bed jacket 10 releasably secured to the body 100 of the wearer. The neckband may be an integral part of the bed jacket 10 or may be fastened by sewing. Near the end 28 of the sleeve portions 18 and 19 distal their attachment to the closed frontal portion 11, there may be an cuff 29 (on each sleeve portion) having elastic 30 attached thereto to elastically and releasably secure the cuff 29 to the arm 10 1 of the wearer. The cuff may have a decorative surface 31 thereon. The multi-compartment belt 23 may have a plurality of fasteners 32 (such as snaps or hook and loop) to releasably close individual compartments 33 (See FIG. 1).

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A bed jacket comprising:

(a) a torso portion comprising:

a closed frontal portion;

a neck opening seam attached to a top portion of the closed frontal portion;

a left arm opening seam and a right arm opening seam attached to the closed frontal portion; and a partially open rear portion attached to the closed frontal portion;

(b) a left sleeve portion and a right sleeve portion attached, respectively, to the left arm opening seam and to the right arm opening seam;

(c) a bib portion releasably attached to a front surface of the closed frontal portion;

(d) a multi-compartment belt attached to the closed frontal portion; and (e) a shoulder support portion, attached to the closed frontal portion and attached to the partially open rear portion, comprising a releasably fastened securing member attached to a neckband member.

* * * * *